US009095501B2

(12) United States Patent
Schofield et al.

(10) Patent No.: US 9,095,501 B2
(45) Date of Patent: Aug. 4, 2015

(54) SOOTHER

(75) Inventors: Paul Schofield, Faceby (GB); Arnold Rees, Gosforth (GB)

(73) Assignee: Jackel International Limited, Cramlington Northumberland (GB)

( * ) Notice: Subject to any disclaimer, the term of this patent is extended or adjusted under 35 U.S.C. 154(b) by 227 days.

(21) Appl. No.: 12/734,280

(22) PCT Filed: Oct. 23, 2008

(86) PCT No.: PCT/GB2008/003593

§ 371 (c)(1),
(2), (4) Date: Aug. 16, 2010

(87) PCT Pub. No.: WO2009/053699

PCT Pub. Date: Apr. 30, 2009

(65) Prior Publication Data

US 2010/0312276 A1 Dec. 9, 2010

(30) Foreign Application Priority Data

Oct. 23, 2007 (GB) ..... 0720730.1

(51) Int. Cl.
*A61J 17/00* (2006.01)

(52) U.S. Cl.
CPC ..... *A61J 17/00* (2013.01)

(58) Field of Classification Search
CPC ..... A61J 17/00; A61J 1/24; B29C 45/14; B29C 45/14344; A61B 1/24
USPC ..... 606/234
See application file for complete search history.

(56) References Cited

U.S. PATENT DOCUMENTS

| | | | | | |
|---|---|---|---|---|---|
| 4,193,407 | A * | 3/1980 | Edmark | 606/234 |
| 4,297,313 | A * | 10/1981 | Duckstein | 264/273 |
| 5,275,619 | A * | 1/1994 | Engebretson et al. | 606/236 |
| 5,725,619 | A * | 3/1998 | Brule et al. | 55/367 |
| 5,759,195 | A * | 6/1998 | Fields et al. | 606/236 |
| 6,776,157 | B2 * | 8/2004 | Williams et al. | 128/203.12 |
| 2003/0100922 | A1 | 5/2003 | Fitzpatrick | |
| 2003/0208234 | A1 * | 11/2003 | Thornton et al. | 606/234 |
| 2007/0021783 | A1 * | 1/2007 | Viana et al. | 606/234 |
| 2009/0248074 | A1 * | 10/2009 | Kliegman et al. | 606/236 |

FOREIGN PATENT DOCUMENTS

| | | | |
|---|---|---|---|
| DE | 3316824 | A1 | 11/1984 |
| DE | 19520540 | A1 | 12/1996 |
| EP | 0892679 | | 1/1999 |
| EP | 1344621 | A1 | 9/2003 |
| GB | 256897 | | 8/1926 |
| GB | 2208291 | A | 3/1989 |
| JP | 62-227356 | | 10/1987 |
| WO | WO 96/27361 | | 9/1996 |
| WO | WO 02/064079 | A1 | 8/2002 |
| WO | WO 2007/028971 | | 3/2007 |
| WO | WO 2007/028971 | A1 | 3/2007 |

OTHER PUBLICATIONS

Machine Translation of DE 20000040 U1, May 4, 2000.*

* cited by examiner

*Primary Examiner* — Ashley Fishback
*Assistant Examiner* — Sidharth Kapoor
(74) *Attorney, Agent, or Firm* — Olson & Cepuritis, Ltd.

(57) ABSTRACT

A soother comprising a teat and a shield is constructed by co-molding the teat and the shield and over-molding the teat material on the shield material. As a result a secure bond is formed and a simple and easily cleanable soother is provided.

30 Claims, 11 Drawing Sheets

SOOTHER

The invention relates to a soother and a method of making a soother.

Conventional soothers, sometimes referred to as dummies, are basically formed of a teat/nipple/baglet which is sucked by a child and a shield or ring on which the teat is mounted to prevent the child from choking on the teat. A common form of soother comprises a multi component assembly wherein the teat, formed of latex or silicone, is formed with an assembly of parts.

As soothers are small devices that go into the mouths of babies and infants, the national/international standards for factors such as strength, material choice and non deformability of soothers are very strict. Only items which have absolute minimum risk are acceptable and this provides many design challenges. They also need to be able to withstand frequent steam-sterilisation without loss of performance.

Figure 1A:
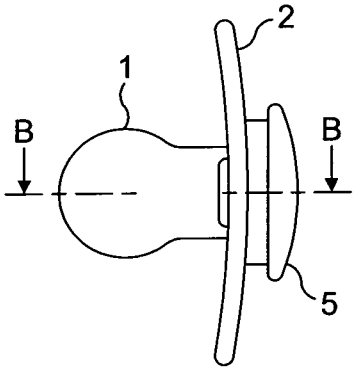
Figure 1B:
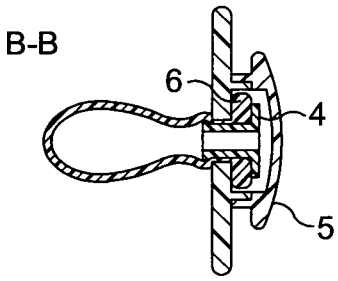

One known soother arrangement is shown in FIGS. 1*a* and 1*b*. A soother includes a teat 1, a hard shield 2 of sufficient diameter that the child cannot insert the soother fully into its mouth, a plug 4 and a cover 5. The teat 1 is generally hollow and includes a flange 6 at its open end which is pushed through an aperture in the centre of the shield to hold the teat in place on the shield.

To prevent removal of the teat from the shield by pulling, the plug 4, which includes a central shaft and a head portion, is inserted into the open end of the teat 1 to press the sides of the teat against the aperture in the shield 2. The head of the plug 4 is of greater diameter than the aperture in the shield 2 such that the teat 1 cannot be pulled through. The cover 5 is then fitted to the rear of the shield 2 to mask the teat flange and plug 4.

As a result the teat 1 is prevented from becoming detached which is significant as it will be seen that, with the exception of the shield component, all of the parts constitute small parts that would pose a choking hazard to infants if detachment occurred. However the resulting assembly is invariably under shear and compressive stresses required to hold the complete assembly together and these inherent assembly stresses can cause premature failure of a soother. Furthermore cleaning of the soother can be difficult in view of the enclosed spaces and assembly can be complex. In addition, while the hard shield 2 is an ideal structural basis on which to secure a soft, flexible baglet/teat, it has the disadvantage of being uncomfortable for the infant—with the hard, inflexible surface pressed against the face.

To aid comfort for infants, it is desirable to have as large an area of soft material as possible adjacent to the infant's face. Therefore an alternative construction comprises soothers manufactured from one single material and in one-piece construction. The hardness of such one-piece soothers is governed by the materials required for the teat and so the soothers are made of soft flexible materials, wherein known one-piece soothers have a usual hardness in the region of 50 Shore A or equivalent. However such known soothers present a potential safety risk to the infant in that the whole product can relatively easily become compressed into a small size which can form a potential choking hazard to the infant. Therefore regulatory requirements are now in place both nationally and internationally to prevent this.

To construct a soother completely from a single soft material such that it would meet regulatory requirements means that a compromise needs to be taken.

Either the material must be relatively hard, thereby ensuring the soother cannot collapse to a size that allows it to become trapped in an infant's mouth or throat, or the material is soft and the thickness of the shield and baglet is exaggerated in order to provide enough mechanical strength to prevent easy deformation. The harder materials suffer from the fundamental comfort problem for the infant, whilst the larger, softer soothers are unattractive and unwieldy, making them less pliable (and hence undesirable with infants). Additionally, they use significantly more material, thereby adding cost.

A known approach to solving the above-mentioned problem is to modify or develop the traditional soother construction, comprising a rigid polycarbonate frame and soft latex or silicone baglets, so as to maximise the area of soft material while retaining a sufficient rigid support. WO2007/028971 (Jackel International Limited) describes soothers where the rigid skeleton has been minimised to a slim retaining ring at the outer edge of the flat 'shield' area. The retaining ring is fixed to the edge of an extended flange area of the baglet ensuring that an infant's face only comes into contact with the soft baglet material. However, the multiple components and the necessary welding between the two halves of the rigid skeleton do not make for easy manufacture.

No known soother provides the advantage of comfort for the infant whilst meeting regulatory requirements with respect to factors such as strength, material, bite resistance and non deformability to prevent choking, without also requiring complex and therefore expensive manufacturing techniques and/or creating increased waste from excess material used during construction.

The invention is set out in the claims. Because the parts are co-moulded, the respective teat and mount portions can be formed of materials having the required relative flexibilities whilst avoiding the risk of a choke hazard by omitting small parts such as plugs, whilst still ensuring a strong bond between the remaining components. Furthermore because of the nature of the co-moulding bond, the stresses inherent in pre-assembled soothers are avoided, lengthening the lifetime of the product.

Embodiments of the invention will now be described, by way of example, with reference to the drawings of which:

FIG. 1*a* shows a plan view of a known form of soother;

FIG. 1*b* shows a cross-sectional side view of the soother of FIG. 1*a;*

Figure 2A:
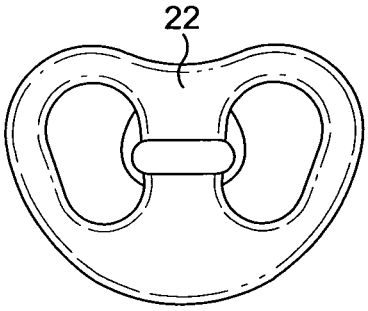
Figure 2B:
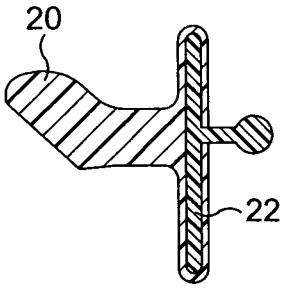

FIG. 2*a* shows a rear view of a soother according to an embodiment of the invention;

FIG. 2*b* shows a sectional side view of a soother according to the embodiment of FIG. 2*a;*

Figure 2C:
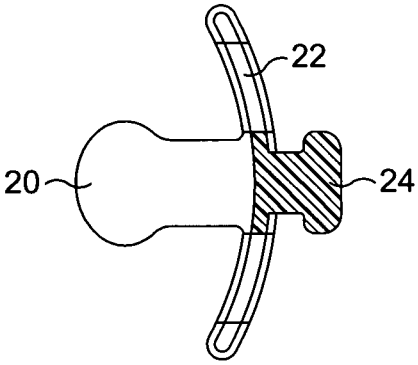

FIG. 2*c* shows a partial sectional plan view of the soother of FIG. 2*a;*

Figure 3A:
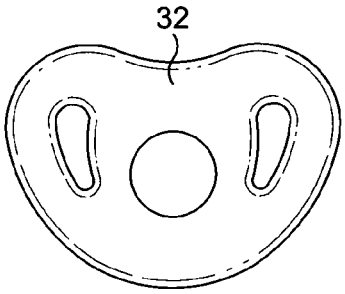
Figure 3B:
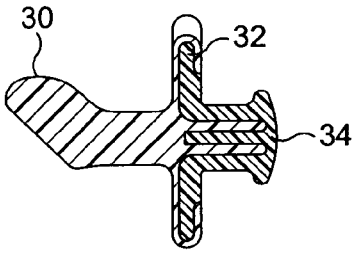

FIG. 3*a* shows a rear view of a soother according to a further embodiment of the invention;

FIG. 3*b* shows a sectional side view of a soother according to the embodiment of FIG. 3*a;*

Figure 3C:
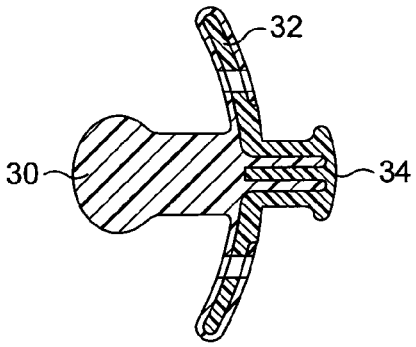

FIG. 3*c* shows a plan view of the soother of FIG. 3*a;*

Figure 4A:
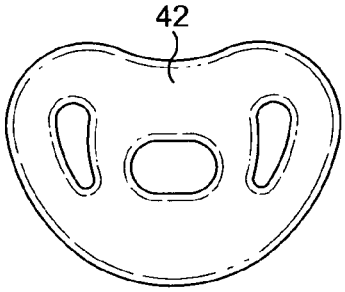
Figure 4B:
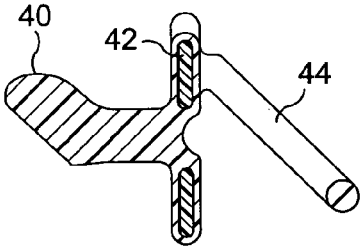

FIG. 4*a* shows a rear view of a soother according to a further embodiment of the invention;

FIG. 4*b* shows a sectional side view of a soother according to the embodiment of FIG. 4*a;*

Figure 4C:
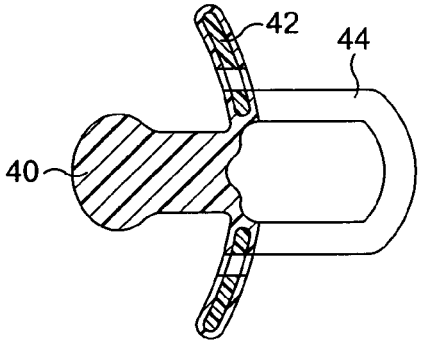

FIG. 4*c* shows a plan view of the soother of FIG. 4*a;*

Figure 5A:
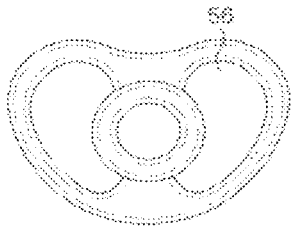
Figure 5B:
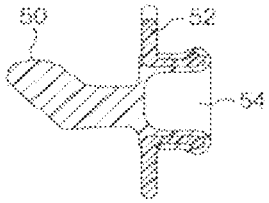

FIG. 5*a* shows a rear view of a soother according to a further embodiment of the invention;

FIG. 5*b* shows a sectional side view of a soother according to the embodiment of FIG. 5*a;*

Figure 5C:
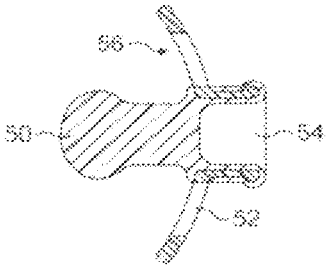

FIG. 5*c* shows a plan view of the soother of FIG. 5*a;*

Figure 6A:
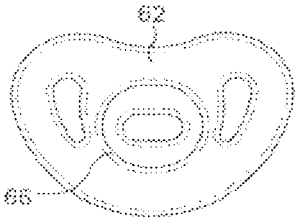
Figure 6B:
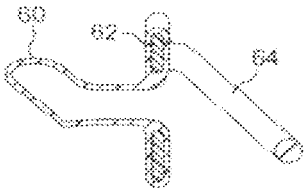

FIG. 6*a* shows a rear view of a soother according to a further embodiment of the invention;

FIG. 6*b* shows a sectional side view of a soother according to the embodiment of FIG. 6*a;*

Figure 6C:
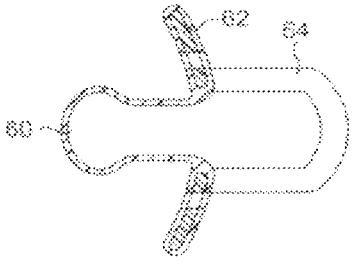

FIG. 6*c* shows a plan view of the soother of FIG. 6*a;*

Figure 7A:
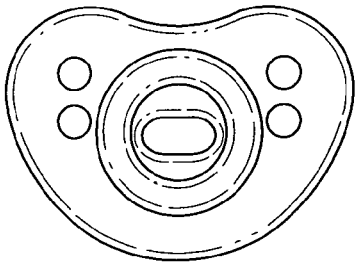
Figure 7B:
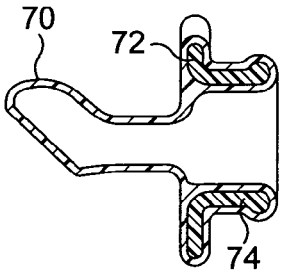

FIG. 7*a* shows a rear view of a soother according to a further embodiment of the invention;

FIG. 7*b* shows a sectional side view of a soother according to the embodiment of FIG. 7*a;*

Figure 7C:
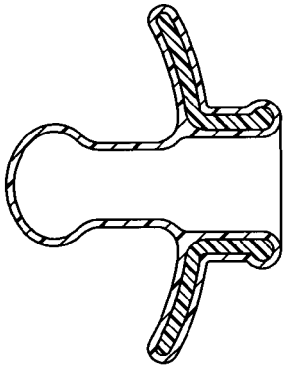

FIG. 7*c* shows a plan view of the soother of FIG. 7*a;*

Figure 8A:
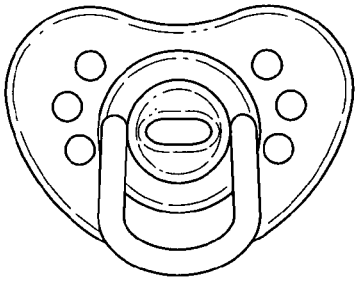
Figure 8B:
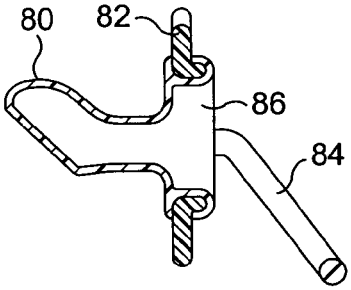

FIG. 8*a* shows a rear view of a soother according to a further embodiment of the invention;

FIG. 8*b* shows a sectional side view of a soother according to the embodiment of FIG. 8*a;*

Figure 8C:
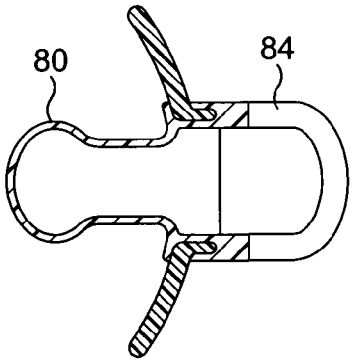

FIG. 8*c* shows a plan view of the soother of FIG. 8*a;*

Figure 9A:
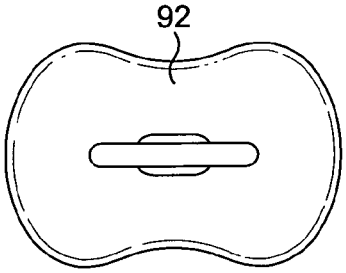
Figure 9B:
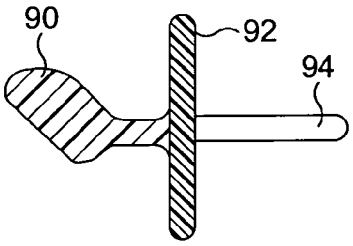

FIG. 9*a* shows a rear view of a soother according to a further embodiment of the invention;

FIG. 9*b* shows a sectional side view of a soother according to the embodiment of FIG. 9*a;*

Figure 9C:
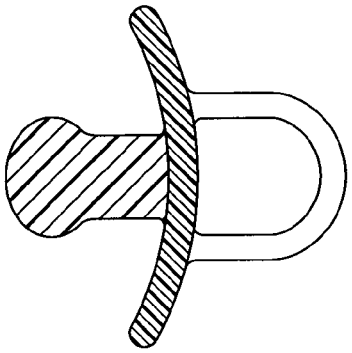

FIG. 9*c* shows a plan view of the soother of FIG. 9*a;*

Figure 10A:
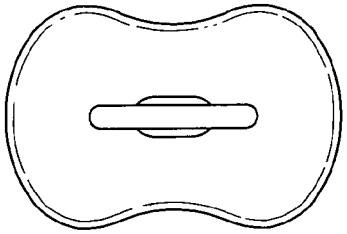
Figure 10B:
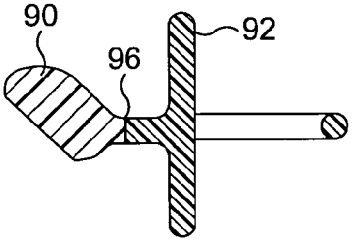

FIG. 10*a* shows a rear view of the soother of FIGS. 9*a* to 9*c* showing a bond plane;

FIG. 10*b* shows a sectional side view of a soother according to the embodiment of FIG. 10*a;*

Figure 10C:
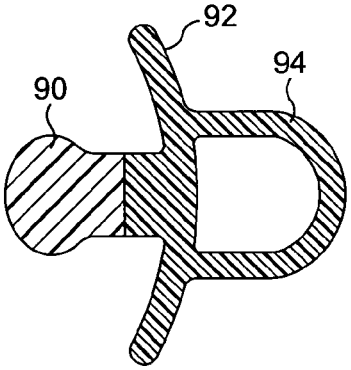

FIG. 10*c* shows a plan view of the soother of FIG. 10*a;*

Figure 11A:
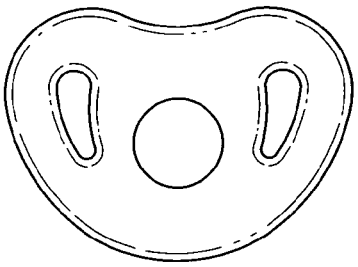
Figure 11B:
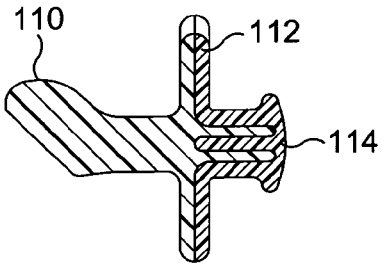

FIG. 11*a* shows a rear view of a soother according to a further embodiment of the invention;

FIG. 11*b* shows a sectional side view of a soother according to the embodiment of FIG. 11*a;*

Figure 11C:
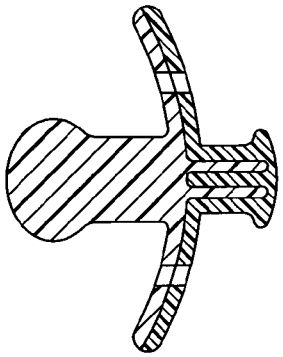

FIG. 11*c* shows a plan view of the soother of FIG. 11*c;*

Figure 12A:
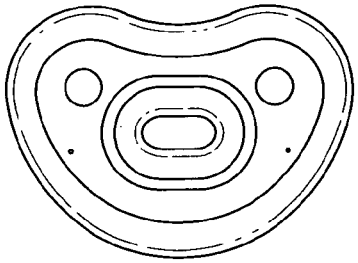
Figure 12B:
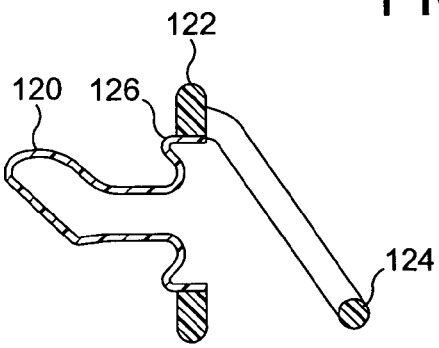

FIG. 12*a* shows a rear view of a soother according to a further embodiment of the invention;

FIG. 12*b* shows a sectional side view of a soother according to the embodiment of FIG. 12*a;*

Figure 12C:
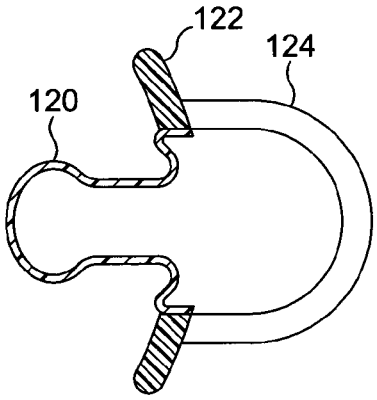

FIG. 12*c* shows a plan view of the soother of FIG. 12*a;*

Figure 13A:
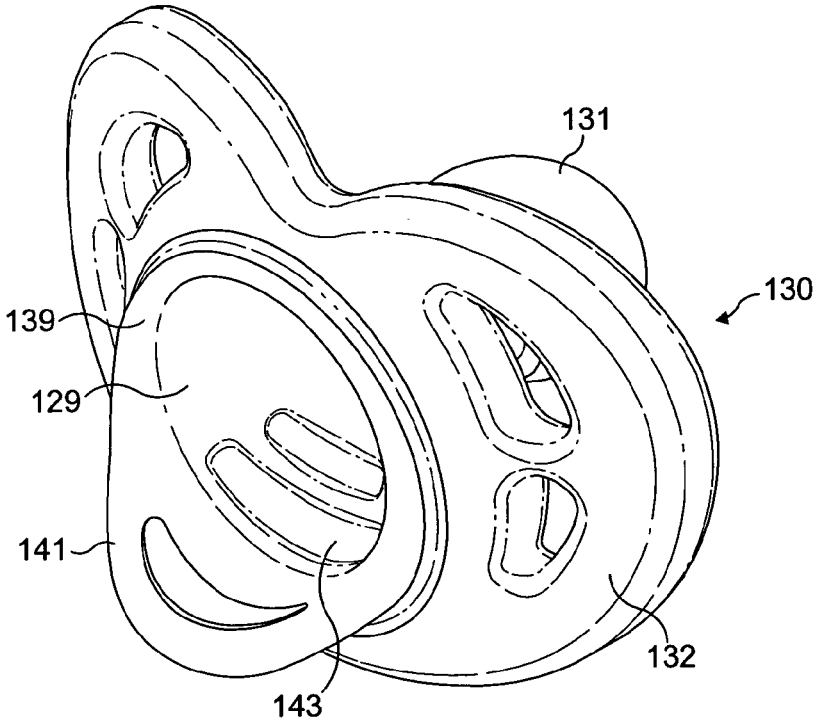
Figure 13B:
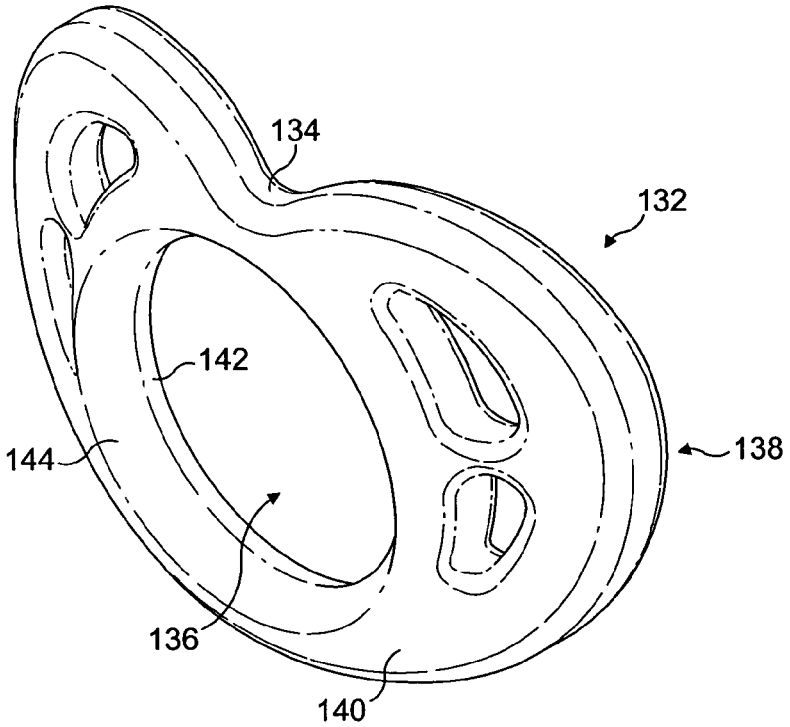

FIG. 13*a* shows a perspective view of a soother according to another embodiment of the invention;

FIG. 13*b* shows a perspective view of the shield that combines with a baglet to form the soother of FIG. 13*a;*

Figure 13C:
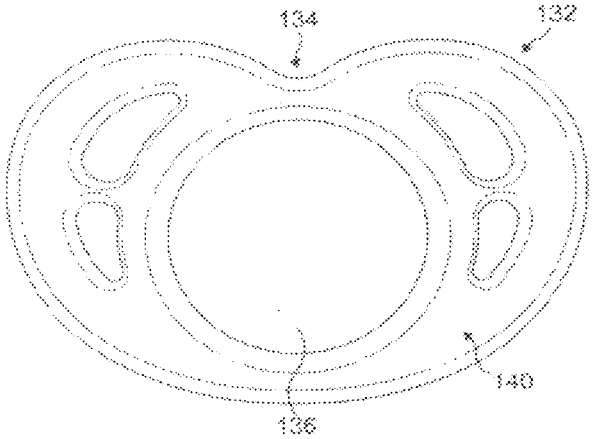

FIG. 13*c* shows a plan view of the outer face of the shield of FIG. 13*b;*

Figure 13D:
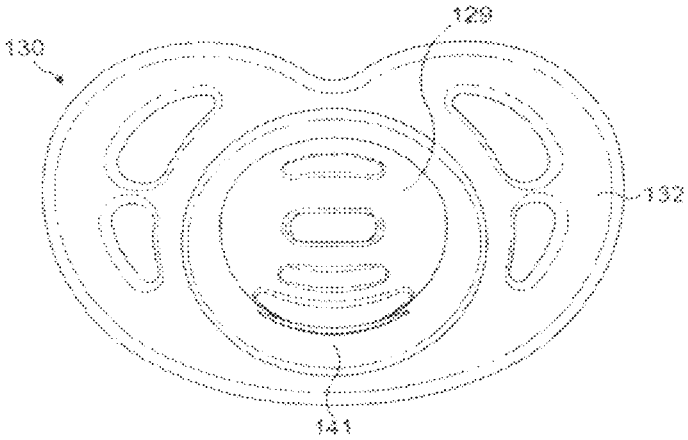

FIG. 13*d* shows a plan view of the lower surface of the soother of FIG. 13*a;*

Figure 13E:
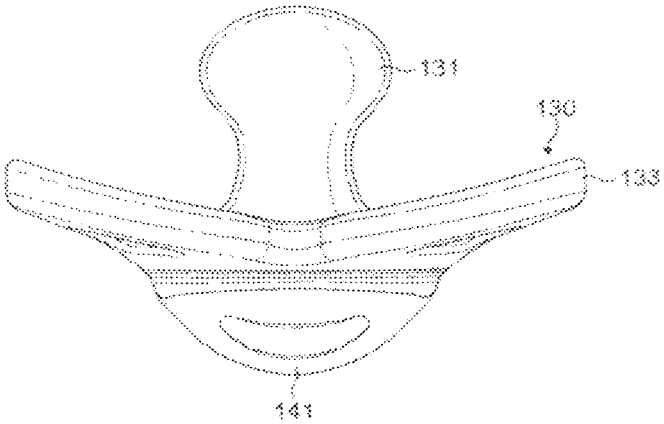

FIG. 13*e* shows a side view of the soother of FIGS. 13*a* and 13*d;*

Figure 13F:
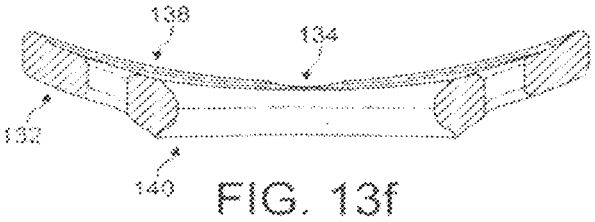

FIG. 13*f* shows a side view of the shield of FIGS. 13*b* and 13*c;*

Figure 14A:
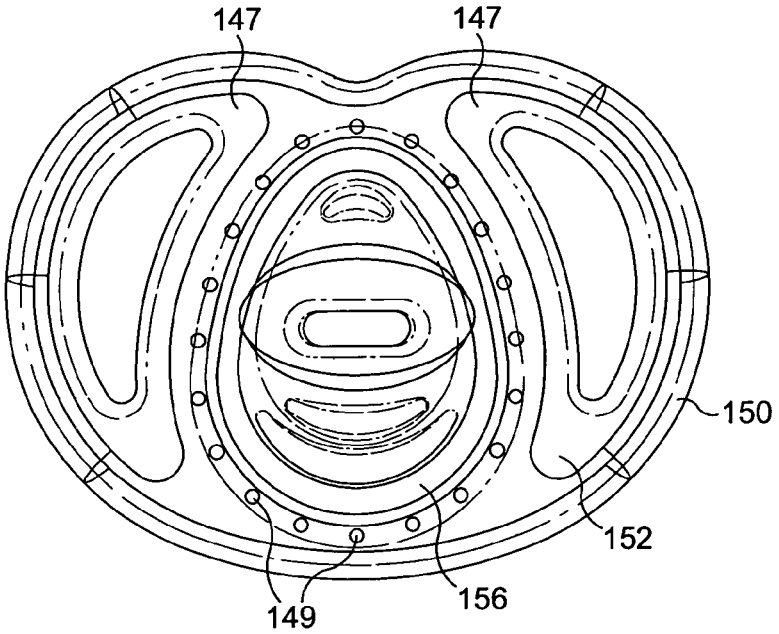
Figure 14B:
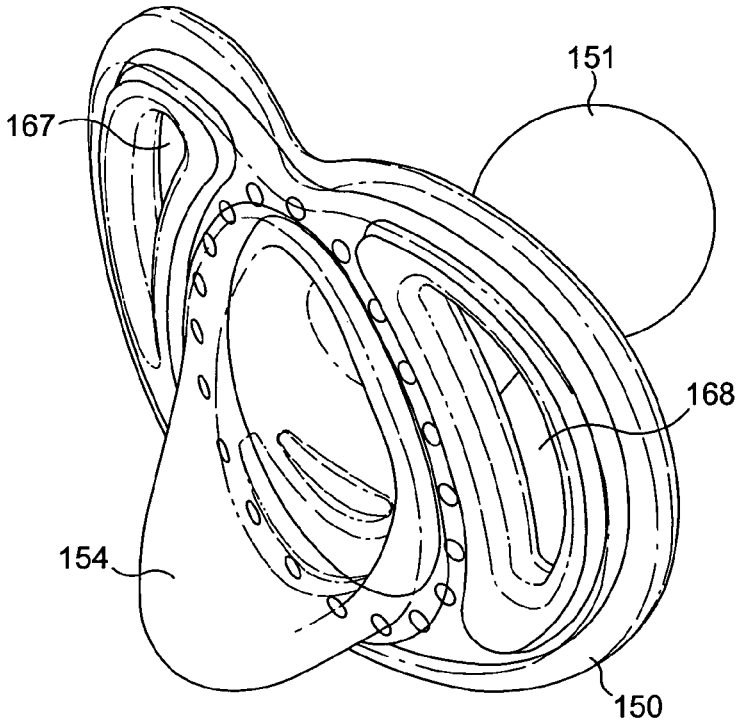

FIG. 14*a* is a rear plan view of a soother according to yet another embodiment of the invention;

FIG. 14*b* is a lower perspective view of the soother of FIG. 14*a;*

Figure 14C:
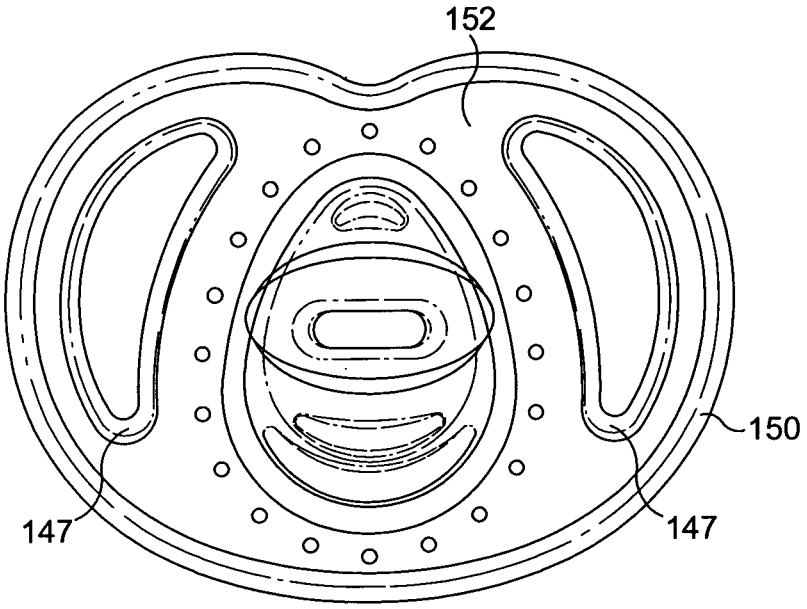
Figure 15:
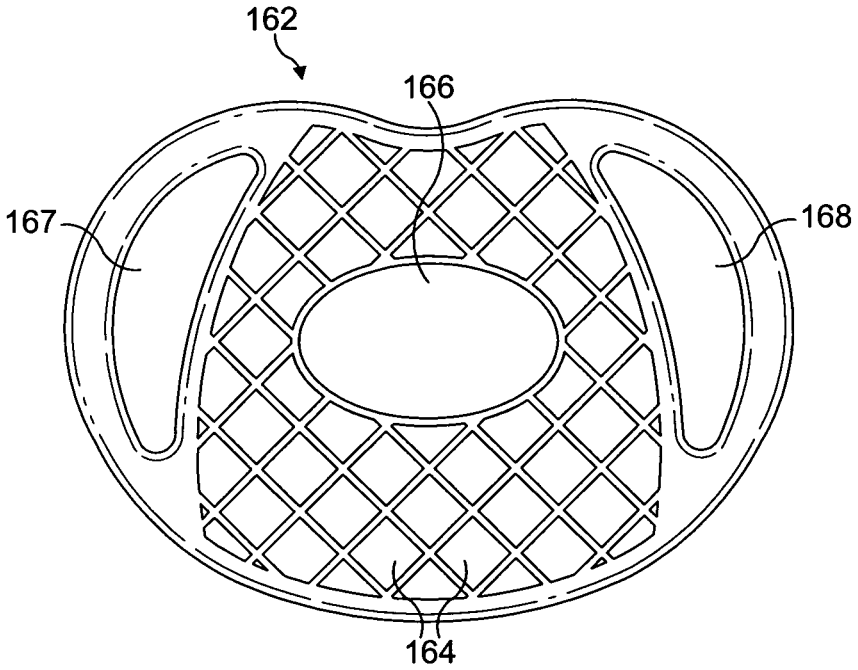

FIG. 14*c* is an upper plan view of the soother of FIGS. 14*a* and 14*b*; and FIG. 15 is a plan view of a shield of a soother according to a yet further embodiment of the invention.

In overview a method of making a soother uses a co-moulding, also known as two-shot moulding, process to mould together the relatively flexible material of the teat with the relatively rigid material of the mount or shield. This provides a strong bond allowing the teat to be secured to the mount solely by the interconnection between the components, and thereby removing the need to include a plug or any other additional components in the soother.

Dependent on the nature of the materials, the two parts can rely on the inherent bond formed during the co-moulding process or the teat can be over moulded onto the whole or a part of the shield to at least partially encapsulate the shield and thus secure it in place. In addition or alternatively, the surface area of the shield and teat can be maximised such that even two materials that have a relatively weak natural surface bond therebetween can form a secure attachment. This increased surface area can, for example, be achieved by providing a sloping wall or ridge extending between the inner and outer faces of the mount or shield. Because the ridge slopes, it provides a larger surface area than it would if it extended substantially perpendicularly between the two faces, but yet it does not require the overall thickness between the two faces to be increased. Hence a relatively thin soother, which is comfortable for an infant to use, can be achieved.

Optionally the mount may be formed in full or in part by a mesh material. Hence a plurality of apertures can be provided through which the soft teat material can extend in order to overmould and encapsulate at least part of the mount. Alternatively, the mesh itself may be encapsulated by a mount material that is less rigid than the mesh but is more rigid than the flexible material used for the teat portion. Hence a soother is provided that optimises rigidity in order to meet safety standards, comfort when the soother presses against an infant's face, and flexibility of the teat portion when subjected to suction during use.

The below-described embodiments ensure that safety is fully attained—which is of paramount importance as soothers are subject to rigorous restrictions, so that they may be left with an infant, without close parental supervision. The soother embodiments additionally provide enhanced simplicity of construction and both immediate and long term performance at a low production cost.

The flexible and semi-rigid parts of a soother can bond together in different manners dependent upon material selection. The preferred manner according to the embodiments described below is co-moulding or two-shot moulding. Where compatible materials are used for the two parts then a bond can be formed between their respective surfaces during the co-moulding process.

In the event that the materials selected are incompatible, little or no bond between the surfaces of the materials may take place. In that event, however, the shield or semi-rigid member can be over-moulded with the teat material such that the shield is encapsulated or partially encapsulated within the teat material providing a very strong and secure interlocking connection. This construction also allows decoration to be applied to the semi-rigid shield member before over-moulding which is often desirable in soothers. Although any appropriate co-moulding process can be used, two particular approaches are described below, namely co-moulding using injection moulding and co-moulding using compression moulding.

The injection moulding process is a well known one in which material to be moulded is injected into an appropriate cavity. The process is particularly appropriate for co-moulding thermo plastic materials. Accordingly the shield portion, which must be a semi-rigid member so as not to pose a choke hazard, can be formed of any suitable material such as PP/PC/PBT. This is co-moulded with a suitable grade of flexible thermo-plastic elastomer (TPE), TPU or liquid silicone rubber (LSR) to form the teat or baglet.

The compression moulding process is appropriate for moulding together, for example, two synthetic rubbers such as silicone which is commonly used for infant feeding bottle teats and for soothers. Indeed, in order to meet modern regulatory requirements, silicone rubber is widely the material of choice for the baglet of a soother. It provides the necessary material strength for tensile test demands, toughness to meet bite test criteria and heat stability to withstand sterilisation. Other soft polymers e.g. some grades of thermoplastic elastomers (TPEs), cannot match the performance of silicone and need to have substantially greater thickness to meet the silicone benchmark. However this increased thickness is undesirable since it reduces baglet flexibility and feels alien to the infant, as discussed as above.

The above notwithstanding, account must be taken when using silicone to manufacture baglets or soothers of the fact that it requires high temperature treatment to ensure all volatile components in the silicone are removed. Without this "post-cure" treatment, currently-available silicone materials would not meet International Standards for contaminants and would not be allowed to be used in a product for a child's mouth.

When a silicone baglet is manufactured as a separate part to the shield of a soother, it can be post-cured before assembly and therefore heat-treated in isolation. However, when the silicone material is co-moulded to another, rigid material, the whole soother must be post-cured and therefore the rigid material is subjected to heat-treatment along with the silicone. For rigid materials typical of soothers, e.g. polycarbonate (PC), polypropylene (PP) or harder grades of TPE, the rigid shield will be damaged by the silicone post-curing process and therefore would be discoloured or misshapen, causing the soother to be rejected. The embodiments according to the present application address this potential technical drawback of silicone using a number of approaches, as discussed further below.

It will be recognised that many different types of soother construction can be made using the co-moulding processes described above and various possibilities are discussed below with reference to FIGS. 2 to 15. It will be recognised that the embodiments shown are not limiting but indicative of possible constructions.

FIGS. 2 to 8 show various soothers in which the teat and shield are co-moulded and secured together by over-moulding.

Referring for example to FIGS. 2*a*, 2*b* and 2*c* it will be seen that a teat 20 which is generally solid is secured to a shield 22 having a handle 24. In particular the material of the teat encapsulates the front and rear faces of the shield and the periphery of the shield, terminating at the handle 24.

FIGS. 3*a*, 3*b* and 3*c* show a variant of the arrangement shown in FIGS. 2*a*, 2*b* and 2*c*. The teat 30 is once again solid and over-moulded onto the shield 32. The shield 32 once again includes a handle or grip portion 34 which is also hollow with a central projection forming a generally annular chamber projecting rearwardly from the shield 32. It will be seen that the teat material also fills the annular chamber to improve the bond yet further.

A further variant of the arrangement shown in FIGS. 2*a*, 2*b* and 2*c* can be seen in FIGS. 5*a*, 5*b* and 5*c*. In this case the shield 52 includes a generally rearwardly projecting cylindrical portion 54 open at both ends to provide a through passage in the shield. The teat 50 which is once again a solid teat is over-moulded on a part of the front face of the shield 52 as well as the inner and outer walls of the cylindrical formation through additional apertures 56 in the shield, and over the rear lip of the cylindrical formation. Once again a secure bond is provided and the cylindrical formation provides a convenient grip.

A further variant of the arrangement shown in FIGS. 2*a*, 2*b* and 2*c* can be seen FIGS. 5*a*, 5*b* and 5*c*. In this case the shield 52 includes a generally rearwardly projecting cylindrical portion 54 open at both ends to provide a through passage in the shield. The teat 50 which is once again a solid teat is over-moulded on a part of the front face of the shield 52 as well as the inner and outer walls of the cylindrical formation through additional apertures 56 in the shield, and over the rear lip of the cylindrical formation. Once again a secure bond is provided and the cylindrical formation provides a convenient grip.

An alternative embodiment is shown in FIGS. 6*a*, 6*b* and 6*c* in which a generally hollow teat 60 is provided over-moulded on a shield 62 having a ring 64 projecting rearwardly from it. The shield 62 has a central aperture 66 such that the shield 62 is generally ring-shaped and the teat material is over-moulded on the front and rear surfaces of the shield and the inner and outer circumferences of the ring. Because the teat is hollow this means that the inside of the teat is accessible via the aperture 66.

FIGS. 7*a* to 7*c* show a variant of the arrangement shown in FIGS. 6*a* to 6*c*. It will be seen that, in a similar manner to FIGS. 5*a* to 5*c* a shield 72 includes an open ended rearwardly projecting cylindrical portion 74 and the teat 70 is moulded over the shield including the cylindrical formation 74. Once again the teat 70 is hollow such that the inside of the teat 70 is accessible via the cylindrical formation 74.

FIGS. 8*a* to 8*c* show a further variant of the arrangement shown in FIGS. 6*a* to 6*c*. Here once again the teat 80 is hollow and co-moulded with a shield 82 which in this embodiment has a ring 84 projecting rearwardly from it. As can be seen the teat 80 is hollow and partially over-moulded on the shield 82. The shield 82 has a central aperture with a rearwardly projecting cylindrical flange and the teat material is over-moulded on the flange as well. The interior of the teat 80 is again accessible through the central aperture 86 in the shield 82.

A further alternative set of embodiments where the co-moulded materials bond together without the need for over-moulding are shown in FIGS. 9 to 11.

Referring firstly to FIGS. 9*a* to 9*c* a solid teat is shown co-moulded with a shield 92 and a ring or grip 94 projecting rearwardly from the shield. In this case the relatively flexible material of the teat 90 and the relatively rigid material of the shield 92 and the ring 94 are selected such that a bond is formed during the co-moulding process as a result of which additional over-moulding to provide secure attachment is not required. Referring to FIGS. 10*a* to 10*c*, where like reference numerals relate to like parts the interface between the flexible material of the teat 90 and the rigid material of the shield 92 can be seen at 96.

Referring to FIGS. 11*a* to 11*c*, a solid teat 110 is co-moulded with a shield 112 having a rearwardly projecting grip 114 of the type described above with reference to FIGS. 3*a* to 3*c*. In the embodiment of FIG. 11, however, the parts are effectively laminated as there is no over-moulding. Once again the materials are bonded together because of their compatibility during the co-moulding process.

More complex teat configurations than those shown in the above-described figures can be adopted of the type, for example, shown in FIGS. 12*a* to 12*c*. Here a teat 120 is co-moulded with a shield 122 and ring 124 and held in place by bonding of the material. It will be seen that the teat 120 includes a bellows portion 126 concentric with the teat and provided in the vicinity of the bond with the shield 122. As a result the teat can more easily move in and out with suction pressure during use.

It will be appreciated that any appropriate material can be used for the relevant soother parts as long as the requirements for the form of bonding or securing the parts together are met. However, as discussed above, silicone is usually the preferred teat material, to meet current standards regarding factors such as bite-resistance and resilience against degradation caused by frequent steam sterilisation. For example the teat can be silicone and the shield formed of PBT. This is a possible configuration for the embodiments of FIGS. 2, 3, 4, 6 and 7.

Alternatively the teat can be formed of TPE and the shield of polypropylene (PP). This is a possible approach for the embodiments of FIG. 5 and FIG. 8. However, TPE is mechanically inferior to silicone, forcing TPE teats to be thicker than equivalent silicone teats.

In order to prevent damage of the shield when it is subjected to heat treatment along with silicone in the above described post-curing process, the rigid skeleton of the shield can comprise of a material having a temperature resistance that is sufficiently high, for example poly-ether-ether-ketone (PEEK) or polyether-block-amides (PEBAX). Such materials for the shield enable the production of a soother in a single piece construction having a hard, rigid skeleton and a silicone baglet. However use of such hard materials is undesirable as these materials are many times more expensive than traditional soother materials.

Where co-moulding relies on strong bonding between the soother materials then a two-shot moulding process using silicone of different respective hardnesses for the soft teat and rigid shield can be adopted. This is the preferred approach for the soother shown in FIGS. 9 and 10. In such a construction, post-curing will have the positive effect of removing volatiles from both materials without any drawbacks from material instability at high temperature. In order to provide a bond strong enough to meet current soother tensile strength standards, the two respective silicone grades that should be used in such a construction are those which have very close grades of hardness (e.g. as measured by the Shore A hardness scale). Therefore, in order to provide sufficient rigidity to the shield the silicone grades may have to have relatively high Shore A hardness, for example in the range 70 to 100. However, as discussed above, this degree of hardness may provide some discomfort to the infant. A preferred construction from the point of view of comfort would be to use two relatively soft silicone grades, for example having Shore A hardness in the range 30 to 70, however such a construction may provide insufficient rigidity and thereby not meet applicable national and/or international safety standards. A potential way around this is to have an over-sized shield to compensate for the material strength deficiencies, however this would make the soother heavy and difficult to use.

It will be appreciated from the above that, in order to provide both sufficient comfort to an infant using a soother and to provide a soother of sufficient rigidity in order to meet the national and/or international safety standards, it is preferable to construct a soother wherein the shield and baglet portions are both composed of silicone and have sufficiently different respective hardness grades. However, it is impossible to apply known techniques in order to mould together two silicone types having substantially different hardnesses in order to provide a bond that is sufficiently strong enough to meet the relevant soother tensile strength standards.

A baglet 129 and shield 132 of a soother 130 that overcomes the above-mentioned problems for construction using two different respective silicone hardness grades are shown in FIGS. 13*a* to 13*f*. The shield 132 is of a similar size to the rigid shield portions in known soother constructions. It is comprised of relatively hard, rigid silicone having a Shore A hardness between 70 to 100, and preferably around 80, thereby ensuring that the finished soother 130 is rigid enough to meet safety criteria. The shield 132 has a rounded outer edge and, in a preferred embodiment, comprises a dip 134 in the centre of the top portion of its outer circumference in order to accommodate an infant's nose and allow more comfortable breathing in use. There is a central cavity 136 extending between the inner 138 and outer 140 faces of the shield. The central cavity 136 defines a substantially annular inner wall 142.

According to a preferred embodiment as shown in FIG. 13*b*, a circumferential ridge 144 is provided around the central cavity 136, either in addition to or instead of the inner wall 142, wherein said circumferential ridge 144 has a profile that extends radially inwards from the outer face 140 of the shield towards the inner face 138. The circumferential ridge 144 slopes at an angle to the central axis through the central cavity 136 of the shield 132, such that an increased surface area is provided without increasing the thickness between the inner 138 and outer 140 faces of the shield 132. The ridge 144 can be substantially planar or can have a substantially curved profile. In the preferred embodiment shown in FIG. 13*b*, the inner wall 142 is formed as a lip at the inner end of the circumferential ridge 144, said inner wall 142 extending substantially parallel to the central axis through the central cavity 136. This lip provides an area which can form a more effective seal with the moulding machinery during construction of the soother 130, thereby increasing reliability of the moulding process and reducing the number of rejects produced.

Although the cavity 136 is shown in FIGS. 13*b* and 13*c* as being substantially circular, it is possible for the cavity to be oval having two lines of symmetry therein, or to be egg-shaped, having one line of symmetry therein, or indeed to be asymmetric. Large air holes are preferably provided extending through the shield 132, to the left and right of the central cavity 136.

The baglet 129 as shown in FIG. 13*a* is comprised of relatively soft silicone, for example of Shore A hardness between 30 and 70, and preferably of Shore A hardness 50. The baglet 129 includes a nipple portion 131 extending inwardly of the inner face 138 of the soother shield 132. The baglet 129 further includes a ring 139 below the base of the nipple portion 131. The ring 139 defines a cavity in the baglet material that corresponds to the central cavity 136 in the shield 132. The nipple portion 131 extending inward of this cavity can be either hollow or solid.

The thickness of the baglet material in the ring 139 structure is thicker than the material in the nipple portion 131 of the baglet 129. Hence the ring 139 itself contributes to the overall rigidity of the soother 130. During construction, the ring 139 is moulded to the inner wall 142 of the central cavity 136 of the shield 132, in the vicinity of which the surface area of the shield 132 has been maximised. Therefore, although the natural surface bonding between the respective materials of the baglet 129 and shield 132 may be relatively weak, a large enough surface area is provided over which the two materials can attach and thereby form a sufficiently strong bond in order for the soother 130 to meet the necessary safety standards. As discussed above, the preferred embodiment of the shield 132 includes a circumferential ridge 144, thereby creating a larger surface area in the vicinity of the cavity 136 without increasing the thickness between the inner and outer faces of the shield 142, hence increasing the bonding between the baglet 129 and the shield 132.

In a further embodiment not shown, a flange portion can be provided at the base of the nipple portion 131 of the baglet 129, wherein said flange is over moulded over the inner face of the shield 132 such that its edges wrap around the corresponding edges of the shield 132. A continuous layer of baglet material is thus provided over at least the inner face of the shield, making it softer in the areas which come in contact with an infant's face during use.

The soft material of the baglet 129 according to these embodiments optimises the baglet function in providing an ideal grade for flex, stretch, bite resistance and other physical properties required for a soother. By using the two distinct grades of silicone in the baglet 129 and shield 132 respectively, the need for either the baglet 129 to be much too hard and therefore uncomfortable to an infant, or for the shield 132 to be too thick or soft, and consequently the soother falling below safety standards is eliminated. Furthermore, the harder-grade silicone that is used for the shield is rigid enough to enable the resulting soother to meet safety standards but is not so rigid that it would cause discomfort for an infant in use. Therefore it is not necessary to overmould the soft baglet material to cover the inner face of the shield 132.

The above-described advantages are enhanced because the soft material has a supplemental ring structure, via which the baglet material contributes to some of the overall mechanical rigidity of the structure. Therefore the rigid silicone material of the shield does not have to be overly hard in order to meet the relevant safety standards. This effect can be seen particularly in embodiments wherein the central cavity 136 of the shield 132 and therefore the corresponding ring 139 of the baglet 129 are of a relatively large diameter i.e. considerably larger than the diameter of the neck of a baglet in a typical known soother comprising two or more components.

The soft baglet materials and supplementary ring structure can be moulded to extend outwards of the outer face 140 of the shield and thereby to create a handle 141, the presence of which is another requirement of the international standards for soothers. With the embodiment of FIGS. 13*a* to 13*f*, the soother is hollow in the nipple portion 131 and has a handle extending from the ring structure of the baglet 129, below the aperture leading to the inner cavity within the nipple portion 131. In such an arrangement the baglet and the handle can be moulded easily and simultaneously, because withdrawal of the metal mould insert that determines the boundaries of the inner wall of the baglet can easily be withdrawn after moulding, without interference from the handle. This means that the soother 130 is easier to manufacture as compared to many known soothers.

As shown on FIG. 13*a*, it is possible for thin regions 143 to be provided in the material of the baglet 129, in the area extending from the ring 139 outwards towards the nipple portion 131 in order to assist with flexibility of the baglet to enable the teat to move in and out with suction pressure applied by an infant during use.

The baglet 129 and shield 132 of FIGS. 13*a* and 13*b* respectively fit together as described above to provide a completely smooth joint line between the two hardness grades of silicone used. As a result, the soother has no areas in which dirt or bacteria can be trapped.

A variation of the embodiment shown in FIGS. 13*a* to 13*f* is shown in FIGS. 14*a* to 14*c*. As shown therein, in addition to bonding to the shield 152 as described with respect to the embodiment in FIGS. 13*a* to 13*f*, the baglet 150 is further secured to the shield by overmoulding. The soft baglet material therefore covers at least a portion of the inner face of the shield 152, increasing the surface area of contact between the respective baglet and shield materials, and laps over its outer edge. As a result, the soother surface is softer in the areas that contact an infant's face in use. Holding areas 147 are provided around the large air holes in the shield, to the left and right of the central cavity, wherein said holding areas allow the second-shot moulding tool to grip the mould and include rims or other raised portions to prevent the soft baglet material from also extending over the edges that define the large air holes.

A series of small holes 149 through the rigid shield 152 are provided around the periphery of the central cavity 156. These holes 149 enable the soft baglet material to penetrate therethrough, to the outer face of the shield. Therefore the soft baglet material at least partially interlocks with the shield, increasing the mechanical engagement between the two components, when adhesion between the surfaces of the two materials would otherwise be too weak for the resulting soother to meet the relevant safety standards.

As shown in FIG. 14*b*, the handle 154 extending from the ring of the baglet may include a series of bumps or other textured portions in order to provide improved grip. In addition, the upper surface area of the nipple portion 151 can include a series of flex and stretch ripples in order to assist natural movement of the soother teat during use. These flex and stretch ripples may also be provided on the flange portion of the baglet 150 around the bottom of the nipple portion 151.

A further alternative shield embodiment is shown in FIG. 15. According to this embodiment, at least a portion of the rigid skeleton of the shield 162 is comprised of a mesh material. The entire skeleton of the silicone shield 162 can be comprised of the mesh material or, alternatively, the shield 162 can include localised regions of the mesh material. As a result of this, when the soft silicone is moulded in the second shot of the two-shot soother construction process, it has an increased surface area through which to become mechanically engaged with the rigid material of the shield.

The size of the mesh openings 164 can be varied. An optimal design includes mesh openings 164 that are large enough to enable the soft silicone material of the baglet to be injection moulded through all the apertures therein but still small enough so that the soft material on either side of the mesh openings 164 forms a smooth continuous surface to provide maximum comfort for the infant.

The only areas where the softer baglet material will not form a continuous layer around the shield 162 are around the left 167 and right 168 air holes and the central cavity 166. Optionally, the softer baglet material can mould just up to the rim of the left 167 and right 168 air holes, without over moulding the perimeter thereof.

As with the other embodiments described above, when constructing a soother using the shield 162 or FIG. 15, the nipple portion of the baglet that extends inwards from the rigid shield can either be hollow or solid. Optionally again, the baglet material can be moulded to form a handle shape extending from the central cavity, in the opposite direction to the extension of the nipple portion.

In a variation to the embodiment shown in FIG. 15, the solid arc extending on the left and right hand sides of the rigid skeleton, around the left 167 and the right 168 air holes, can be removed, such that the shield 162 comprises only the central mesh portion. In such an embodiment, the outer arms that define the air holes can be completely moulded in the softer baglet material of the second shot moulding.

In a further variation to the embodiment shown in FIG. 15 the mesh material can be formed of a third material, distinct to the shield and baglet silicone materials. The rigid mesh can be encapsulated in the shield formed of the relatively hard grade silicone, in order to provide sufficient rigidity to the shield structure whilst avoiding the need to use an uncomfortably hard grade of silicone for the inner face of the shield, which is in contact with an infant's face during use. Such an arrangement thus means that the outer material of the shield component can be of a softer grade than would otherwise be possible without the reinforced mesh, because the mesh provides the required rigidity in order for the resulting soother to pass the relevant safety standards. This means that if soft baglet material is over moulded over at least part of the shield, the respective hardnesses of the silicone grades used for the shield and the baglet can be close enough to enable the two materials to co-mould to one another with an acceptable amount of adhesion. Such an arrangement can also reduce the need for over-moulding of the soft baglet material over the shield material for comfort reasons.

In one preferred approach as discussed above, the construction uses silicone materials for at least the baglet and preferably also the shield since it provides appropriate material performance properties for soothers; being flexible and strong whilst being comfortable when in contact with an infant's face. Furthermore silicone does not degrade in use retaining most of its mechanical properties. However, it is envisaged that a wide range of soft and hard material can be combined in the manner described above, particularly using the shield embodiment of FIG. 15, since the structural integrity of the final soother allows improved mechanical interlocking of the soft and hard materials. This mechanical interlocking via the mesh configuration of the shield will allow previously unreliable combinations of hard and soft materials to be successfully combined since there would be minimal necessity for the two surfaces of the two materials to have a strong adhesion to one another.

As an alternative to silicone, materials can be used for the baglet and shield if they have low enough volatile content such that there is no need for post-curing to meet the present safety standard. Alternatively, a material can be used for the baglet which does not require a post-cure process involving heat but instead can be post-cured using cold-curing techniques. These alternative baglet options provide the possibility of producing a soother having a cheap rigid skeleton material such as PC or PP, whilst still allowing incorporation of a sufficiently soft baglet that is comfortable for the infant during use.

The particular co-moulding process, be it injection moulding or compression moulding, can be adopted as appropriate dependent on the type of material being used for a particular soother construction. In any case, it will be seen that because of the simplicity of the soother's construction for the above-described embodiments and, correspondingly, the low number of parts are required to secure the components together, there are no enclosed spaces which could otherwise present dirt/bacteria traps that are difficult to clean and therefore potentially harmful to an infant. Either the teat is solid and mates with all adjacent surfaces of the shield or the teat is hollow but accessible through the shield. All surfaces of the soother are therefore visible and accessible for cleaning.

As a result of the co-moulding approach adopted according to the embodiments, numerous other advantages are also provided. The soother has a safe construction because of the semi-rigid nature of the shield reducing the risk of collapse and hence preventing choking hazard to the infant. The soother is completely free from assembly stresses hence avoiding the risk of premature failure that such stresses can cause. Furthermore, in the case of a hollow teat construction there is no risk of trapped water/chemical sterilising solutions as all surfaces are free draining.

In the soother embodiments having a ring structure in the soft baglet material and a corresponding inner wall and/or circumferential ridge in the rigid shield, the surface area provided for adhesion between the two materials is maximised. Therefore two materials that conventionally could not be used together in a co-moulded soother due to poor natural adhesion therebetween, for example two silicone materials having different hardness grades, can successfully be used together. Therefore a soother can be produced wherein all the materials therein are damage-protected, and indeed benefit from, post-curing processes using heat treatment to reduce the volatile content of the baglet material.

The above-described effect is particularly pronounced in embodiments wherein the inner wall comprises, in full or in part, a ridge that extends radially inwards between the outer and inner faces of the shield. By extending radially inward in this manner, the ridge increases the surface area provided for adhesion of the shield to the baglet material, without the need to increase the cross-sectional thickness of the shield between the two faces. Hence the soother does not have to be overly-rigid, which would otherwise create discomfort for an infant using the soother. In addition, the use of a ridge in combination with the inner wall, wherein the ridge extends at an acute angle outwardly of the inner wall, creates a lip or other grip means for moulding machinery to use when forming the soother, hence improving ease of manufacture.

Similarly, in soother embodiments wherein some of or the entire rigid shield comprises a mesh material, a large area is provided over which the soft baglet material can bond to the rigid shield material. Again this means that two materials that conventionally could not be co-moulded together to form a sound soother that meets the requisite safety standards can now be used together successfully for this purpose.

In embodiments wherein a rigid mesh is encapsulated by the shield material, the shield material is relatively soft and thus comfortable to an infant, regardless of whether any baglet material is overmoulded thereover, and the resulting soother is also sufficiently rigid and resistant to crumpling in order to meet the necessary safety standards.

The co-moulding approach described allows automated manufacturing methods that largely eliminate defective soothers being produced during assembly, hence making manufacture more efficient and cost-effective. Where decoration is required the shield can be moulded and decorated before over-moulding the baglet/teat material thereover.

It will be appreciated that features of the embodiments described above can be interchanged and juxtaposed as appropriate. For example any shape and type of teat whether hollow or solid can be incorporated with any of the types of shield described above, and any form of grip in the form for example of a ring or knob can be used accordingly.

The invention claimed is:

1. A method of making a soother comprising co-moulding a teat portion formed of a first relatively flexible material and a shield formed of a second relatively rigid material such that the first relatively flexible material of teat portion is more flexible than the second relatively rigid material of the shield, the shield including a substantially central aperture defined by an aperture wall including a sloping ridge and extending between inner and outer faces of the shield, and the teat portion including a fortified ring structure below a base of the teat portion corresponding to the aperture wall and the fortified ring structure extending away from the outer face of the shield such that the teat portion and the fortified ring structure are one piece and made of the first relatively flexible material, the fortified ring structure contributing to the overall mechanical rigidity of the structure, the method comprising co-moulding a surface of the fortified ring structure to a surface of the sloping ridge of the aperture wall such that the fortified ring structure defines a cavity in the teat portion and the teat portion is bonded to the shield by co-moulding the teat portion only to the shield.

2. The method of claim 1 in which the mounted portion comprises a shield.

3. The method of claim 1 in which the co-moulding step comprises one of injection moulding and compression moulding.

4. The method of claim 1 in which the surfaces of the teat portion and mount portion are bonded together as a result of the co-moulding process.

5. The method of claim 1 in which the teat portion is over-moulded on the shield.

6. The method of claim 5 in which the teat portion is partially over-moulded on the shield.

7. The method of claim 5 wherein the teat portion forms an interlock with at least part of the shield.

8. A soother comprising:

a shield having an inner face opposite an outer face and a substantially central aperture defined by an aperture wall including a sloping ridge and extending between the inner face and the outer face;

a flexible teat portion being made of a single material that is relatively flexible with respect to the shield and secured to the shield solely by moulding, having a nipple portion connected to a base portion, the base portion being connected to a fortified ring structure such that the nipple portion, the base portion and the fortified ring structure of the flexible teat portion are unitary; and wherein the fortified ring structure of the teat portion is less flexible than at least a part of the nipple portion of the teat portion, defines a cavity in the flexible teat portion, is sized to correspond with the aperture wall such that the fortified ring structure has a diameter and thickness that is large enough to contribute to the overall mechanical rigidity of the soother, and is bonded to the sloping ridge of the aperture wall by co-moulding such that the fortified ring structure is only bonded to the shield.

9. The soother of claim 8 in which the teat portion is over-moulded on the shield.

10. The soother of claim 8 in which a surface of the teat portion is bonded to a surface of the mount portion.

11. The soother of claim 8 in which the mount portion comprises a shield.

12. The soother of claim 8 wherein the flexible teat portion and the shield are each formed of silicone material.

13. The soother of claim 12 wherein the flexible teat portion comprises silicone material of between 30 and 70 Shore Hardness A as reflected by the Shore A scale, and wherein the shield comprises silicone material of between 70 and 100 Shore Hardness A as reflected by the Shore A scale.

14. The soother of claim 8 wherein the mount portion comprises a substantially central aperture defined by an inner wall, extending between inner and outer faces of the mount portion.

15. The soother of claim 14 wherein the teat portion includes a fortified ring structure that corresponds to the inner wall of the mount portion such that a bond is formed between the respective surfaces of the inner wall and the ring structure.

16. The soother of claim 8 wherein the aperture wall includes a sloping ridge extending between the inner and outer faces of the shield.

17. The soother of claim 8 wherein the shield further includes a plurality of holes located substantially around the perimeter of the central aperture.

18. The soother of claim 8 wherein at least part of the shield comprises a mesh material, having a plurality of apertures therein.

19. The soother of claim 18 wherein the mesh material is encapsulated by a continuous material to form an exterior surface of the shield.

20. The soother of claim 8 wherein the teat portion includes at least one relatively thin region to provide increased flexibility of the teat portion in use.

21. The soother of claim 8 in which the teat portion is substantially hollow.

22. The soother of claim 21 in which the interior of the teat is accessible via the central aperture in the shield.

23. The soother of claim 8 in which the teat portion is substantially solid.

24. The soother of claim further comprising a handle.

25. The soother of claim 24 wherein the handle is formed as an extension of the teat portion.

26. The soother of claim 8 wherein the substantially central aperture of the shield and the fortified ring structure of the teat portion have a circular cross section.

27. The soother of claim 8 wherein the substantially central aperture of the shield and the fortified ring structure of the teat portion have an oval cross section.

28. The soother of claim 8 wherein the substantially central aperture of the shield and the fortified ring structure of the teat portion have an egg shaped cross section.

29. The soother of claim 8 wherein the substantially central aperture of the shield and the fortified ring structure of the teat portion have an asymmetric cross section.

30. The soother of claim 8 wherein the thickness of the material at the fortified ring structure is greater than the thickness of the material at the nipple portion.

* * * * *

UNITED STATES PATENT AND TRADEMARK OFFICE

CERTIFICATE OF CORRECTION

PATENT NO. : 9,095,501 B2
APPLICATION NO. : 12/734280
DATED : August 4, 2015
INVENTOR(S) : Paul Schofield and Arnold Rees It is certified that error appears in the above-identified patent and that said Letters Patent is hereby corrected as shown below:

In the claims,

Column 14, line 27, Claim 24, delete “claim further” and insert --claim 8 further--

Signed and Sealed this
First Day of March, 2016

Michelle K. Lee

Michelle K. Lee
*Director of the United States Patent and Trademark Office*